US007812798B2

(12) United States Patent
Chen

(10) Patent No.: US 7,812,798 B2
(45) Date of Patent: Oct. 12, 2010

(54) OLED DISPLAY DEVICE WITH HIGH OUTPUT IMPEDANCE

(75) Inventor: Chi-Chang Chen, Tao-Yuan (TW)

(73) Assignee: Princeton Technology Corporation, Hsin Tien, Taipei County (TW)

( * ) Notice: Subject to any disclaimer, the term of this patent is extended or adjusted under 35 U.S.C. 154(b) by 729 days.

(21) Appl. No.: 11/565,610

(22) Filed: Nov. 30, 2006

(65) Prior Publication Data

US 2007/0290953 A1 Dec. 20, 2007

(30) Foreign Application Priority Data

Jun. 16, 2006 (TW) ..... 95210551 U

(51) Int. Cl.
*G09G 3/32* (2006.01)

(52) U.S. Cl. ..... 345/82; 315/169.1; 315/169.3

(58) Field of Classification Search ..... 345/36, 345/39, 44–46, 76–104, 204–215, 691–693; 315/169.1, 169.3; 313/463; 250/552; 340/815.45
See application file for complete search history.

(56) References Cited

U.S. PATENT DOCUMENTS

2007/0091030 A1 * 4/2007 Drevillon et al. ..... 345/76

FOREIGN PATENT DOCUMENTS

JP 06061859 A * 3/1994

* cited by examiner

*Primary Examiner*—Kevin M Nguyen
*Assistant Examiner*—Kenneth B Lee, Jr.
(74) *Attorney, Agent, or Firm*—Winston Hsu; Scott Margo; Min-Lee Teng

(57) ABSTRACT

An OLED display device includes a current source and an OLED equivalent module. The current source includes a first controller, two biased sources, and two PMOS transistors. The current source outputs current to the OLED equivalent module to enable the OLED equivalent module emitting light.

6 Claims, 2 Drawing Sheets

OLED DISPLAY DEVICE WITH HIGH OUTPUT IMPEDANCE

BACKGROUND OF THE INVENTION

1. Field of the Invention

The present invention relates to an OLED display device, and more particularly, to an OLED display device with high output impedance.

2. Description of the Prior Art

Please refer to FIG. 1. FIG. 1 is a circuit diagram illustrating a conventional OLED display device 100. The OLED display device 100 comprises a current source 110 and an OLED equivalent module 120. The current source 110 comprises a voltage source VH, a controller 111, and a p-type transistor Q1. The OLED equivalent module 120 comprises 2 resistors R1 and R2, an OLED D1, and an equivalent capacitor C1. The voltage source VH biases the p-type transistor Q1 at the saturation region. The current source 110 transmits controlling voltage V1 to the gate of the p-type transistor Q1 to control the current I1 by the controller 111. Theoretically, the output resistance of the current source should be infinite, and thus, no matter what the load coupled to the current source is, stability and output abilities of the current source are not affected. In fact, the conventional current source 110 has an equivalent output resistor having a resistance of Rd. Thus, if the OLED equivalent module 120 overloads the current source 110, that is, the equivalent load resistor of the OLED equivalent module 120 is not ignored compared with the resistor Rd, the current I1 is affected and the size of the current I1 is changed from the ideal status. Thus, the lumen is not even everywhere on the OLED display device.

SUMMARY OF THE INVENTION

It is therefore a primary objective of the claimed invention to provide an OLED display device to solve the above-stated problems.

The present invention provides an organic light emitting diode (OLED) display device with high output impedance, comprising a current source, comprising a first MOS transistor comprising a gate; a first node; and a second node; a second MOS transistor providing high impedance comprising a gate; a first node, coupled to the second node of the first MOS transistor; and a second node; a first controller coupled to the gate of the first MOS transistor, providing a controlling signal for controlling a current through the first MOS transistor; a first voltage source coupled to the gate of the second MOS transistor, providing a first voltage to the gate of the second MOS transistor; and a second voltage source coupled to the first node of the first MOS transistor, providing a second voltage to the first MOS transistor; and an OLED equivalent module coupled to the second node of the second MOS transistor, generating a light according to a current through the second MOS transistor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
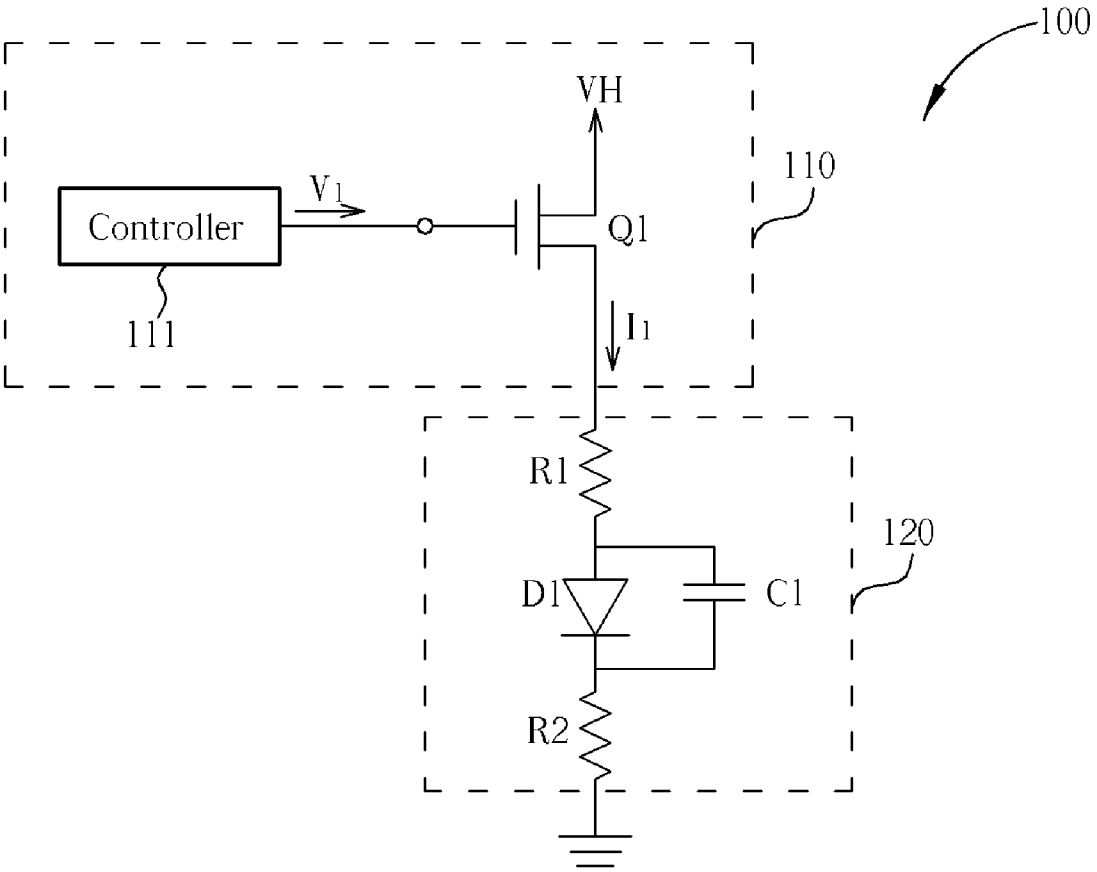
Fig. 1 Prior Art
FIG. 1 is a circuit diagram illustrating a conventional OLED display device.
Figure 2:
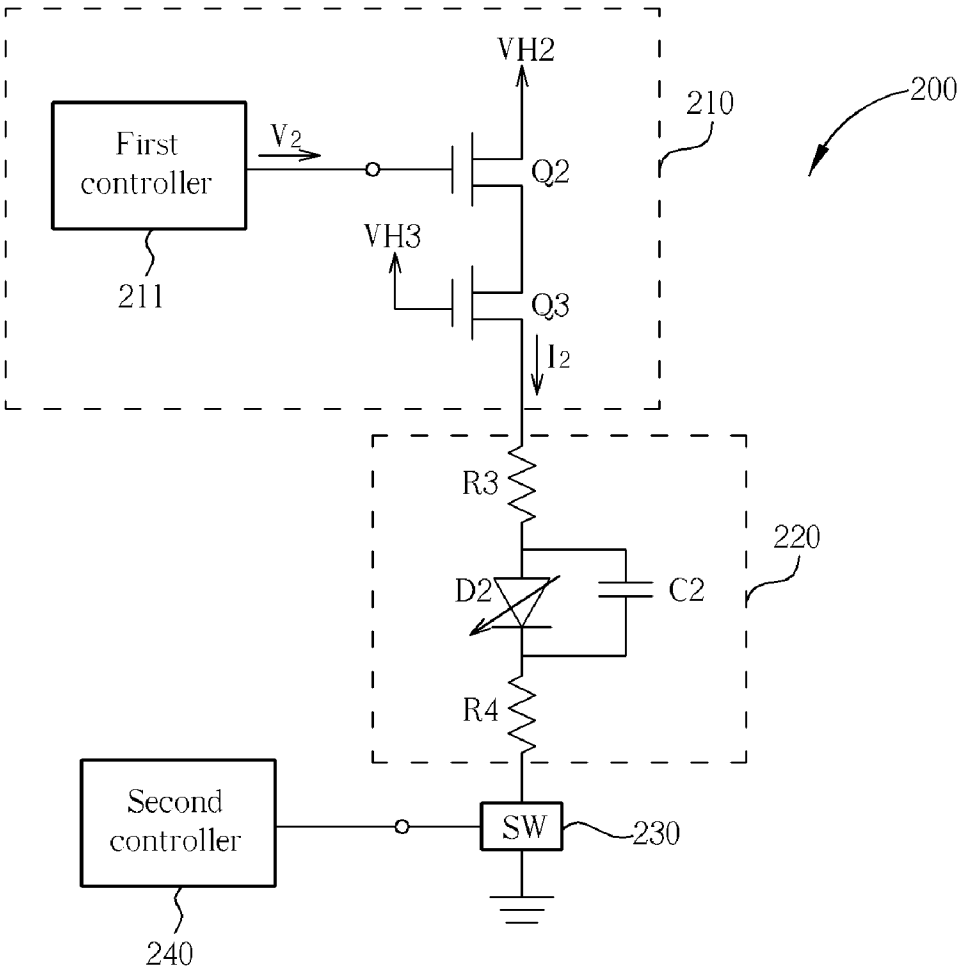
FIG. 2 is a circuit diagram illustrating the OLED display device of the present invention.

Please refer to FIG. 2. FIG. 2 is a circuit diagram illustrating the OLED display device 200 of the present invention. The OLED display device 200 comprises a current source 210, an OLED equivalent module 220, a second controller 240, and a switch 230. The current source 210 comprises a first controller 211, 2 voltage sources VH2 and VH3, 2 p-type transistors Q2 and Q3. The OLED equivalent module 220 comprises 2 resistors R3 and R4, an OLED D2, and a capacitor C2. As shown in the current source 210 of FIG. 2, the output node of the first controller 211 is coupled to the gate of the p-type transistor Q2, the source of the p-type transistor Q2 is coupled to the voltage source VH2, and the drain of the p-type transistor Q2 is coupled to the p-type of the transistor Q3. The gate of the p-type transistor Q3 is coupled to the voltage source VH3, the source of the p-type transistor Q3 is coupled to the p-type transistor Q2, and the drain of the p-type transistor Q3 is coupled to the OLED equivalent module 220. In the OLED equivalent module 220, the resistor R3 is coupled between the source of the p-type transistor Q3 and the positive node of the OLED D2, the resistor R4 is coupled between the switch 230 and the negative node of the OLED D2, the capacitor C2 is coupled between the resistors R3 and R4, and the OLED D2 is coupled between the resistors R3 and R4. The output node of the second controller 240 is coupled to the controlling node of the switch 230, and the switch 230 is coupled between the ground and the resistor R4. The voltage sources VH2 and VH3 bias the p-type transistors Q2 and Q3 at the saturation region. The current source 210 transmits the controlling voltage V2 to the gate of the p-type transistor Q2 by the first controller 211 for controlling the current I2. And the OLED equivalent module 220 generates light according the size of the current I2. The current source 210 of the OLED display device 200 has the equivalent output resistor which the resistance of is μRd and is much bigger than the output resistor of the current source of the conventional OLED display device. Thus, the current source of the present invention is able to be used for higher loads while the effect from the load is comparatively smaller. Consequently, the current source 210 provides a more stable current to the OLED display device 200 so that the OLED display device 200 has a better performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An organic light emitting diode (OLED) display device with high output impedance, comprising:

a current source, comprising:

a first MOS transistor comprising:

a gate;

a first node; and a second node;

a second MOS transistor providing high impedance comprising:

a gate;

a first node, coupled to the second node of the first MOS transistor; and a second node;

a first controller coupled to the gate of the first MOS transistor, providing a controlling signal for controlling a current through the first MOS transistor;

a first voltage source coupled to the gate of the second MOS transistor, providing a first voltage to the gate of the second MOS transistor; and a second voltage source directly coupled to the first node of the first MOS transistor, providing a second voltage to the first MOS transistor; and an OLED equivalent module directly coupled to the second node of the second MOS transistor, generating a light according to a current through the second MOS transistor.

2. The display device of claim 1 further comprising a switch coupled between the OLED equivalent module and a grounding node for controlling the OLED equivalent module to turn on or to turn off.

3. The display device of claim 1, wherein the first MOS transistor and the second MOS transistor operate at a saturation region.

4. The display device of claim 1, wherein the first MOS transistor is a p-type MOS transistor.

5. The display device of claim 1, wherein the second MOS transistor is a p-type MOS transistor.

6. The display device of claim 1, wherein the OLED equivalent module comprises:

a first resistor directly coupled to the second node of the second MOS transistor;

a second resistor coupled to a grounding node;

a capacitor coupled between the first resistor and the second resistor; and an OLED coupled between the first resistor and the second resistor, for emitting a light according to a current passing through the OLED.

* * * * *